United States Patent [19]

Shepard, Jr.

[11] 4,176,977

[45] Dec. 4, 1979

[54] PROPORTIONAL CARRIER CONTROL AND MOVING MECHANISM FOR ELECTRIC TYPEWRITER

[75] Inventor: Francis H. Shepard, Jr., Summit, N.J.

[73] Assignee: Realty & Industrial Corporation, Morristown, N.J.

[21] Appl. No.: 884,560

[22] Filed: Mar. 8, 1978

[51] Int. Cl.[2] ..... B41J 19/58

[52] U.S. Cl. ..... 400/320; 400/322; 400/280; 400/161.1; 400/314.1; 400/314.3; 400/903; 400/306

[58] Field of Search ..... 400/52, 161.1, 280, 400/320, 322, 314.1, 314.3, 903, 306; 318/685, 696

[56] References Cited

U.S. PATENT DOCUMENTS

| | | | |
|---|---|---|---|
| 3,292,530 | 12/1966 | Martin | 400/280 X |
| 3,554,347 | 1/1971 | Perkins | 400/320 |
| 3,858,702 | 1/1975 | Azuma | 400/320 |
| 3,942,619 | 3/1976 | Nordstrom et al. | 400/903 X |
| 4,024,447 | 5/1977 | Epstein | 318/696 |
| 4,024,941 | 5/1977 | Sekikawa et al. | 400/903 X |
| 4,030,591 | 6/1977 | Martin et al. | 400/320 X |
| 4,034,842 | 7/1977 | Giacone | 400/322 X |
| 4,091,316 | 5/1978 | Friedman | 318/696 |
| 4,119,383 | 10/1978 | Watanabe et al. | 400/320 X |
| 4,119,901 | 10/1978 | Leenhouts | 318/696 X |

FOREIGN PATENT DOCUMENTS

| | | | |
|---|---|---|---|
| 1403630 | 8/1975 | United Kingdom | 400/322 |

*Primary Examiner*—Ernest T. Wright, Jr.
*Attorney, Agent, or Firm*—Burgess, Ryan and Wayne

[57] ABSTRACT

A drive arrangement for a single element typewriter in which the element is mounted on a moving carrier, for facilitating proportional spacing incremental movements of the carrier. The carrier is bidirectionally driven by a servo motor which rotates bidirectionally in response to the output of a digital counter. The counter counts in one direction in response to input stepping pulses as well as pulses corresponding to incremental rotational movements of the drive shaft in a given direction, and counts in the other direction in response to pulses corresponding to incremental rotational movements of the drive shaft in the opposite direction. The pulses corresponding to incremental rotational movements of the drive shaft are optically derived from a rotating disk having alternating transparent and opaque radial striations. Provision is made for automatic carrier return by setting the output of the counter accordingly.

9 Claims, 13 Drawing Figures

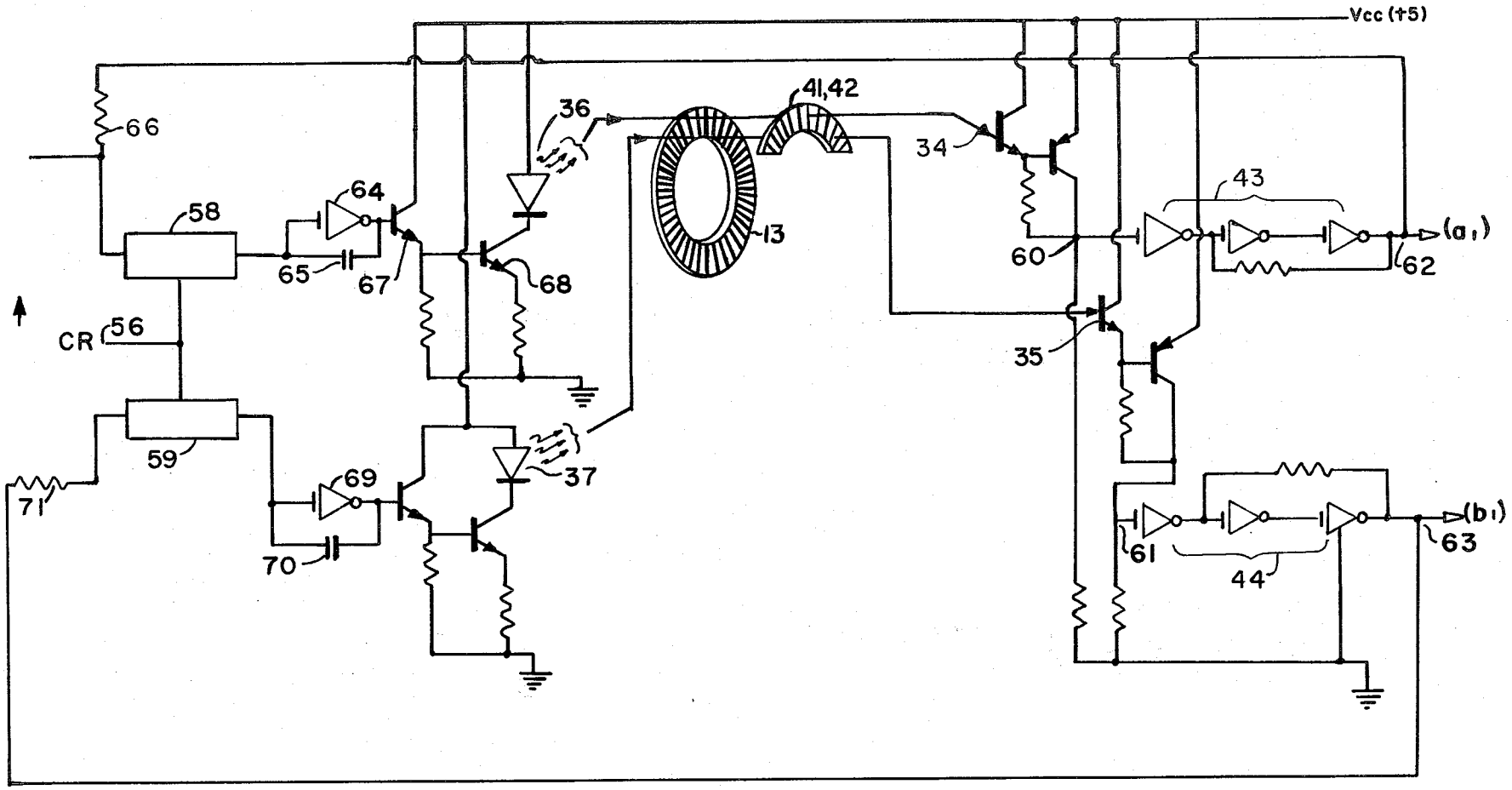
Fig. 5 Sheet A

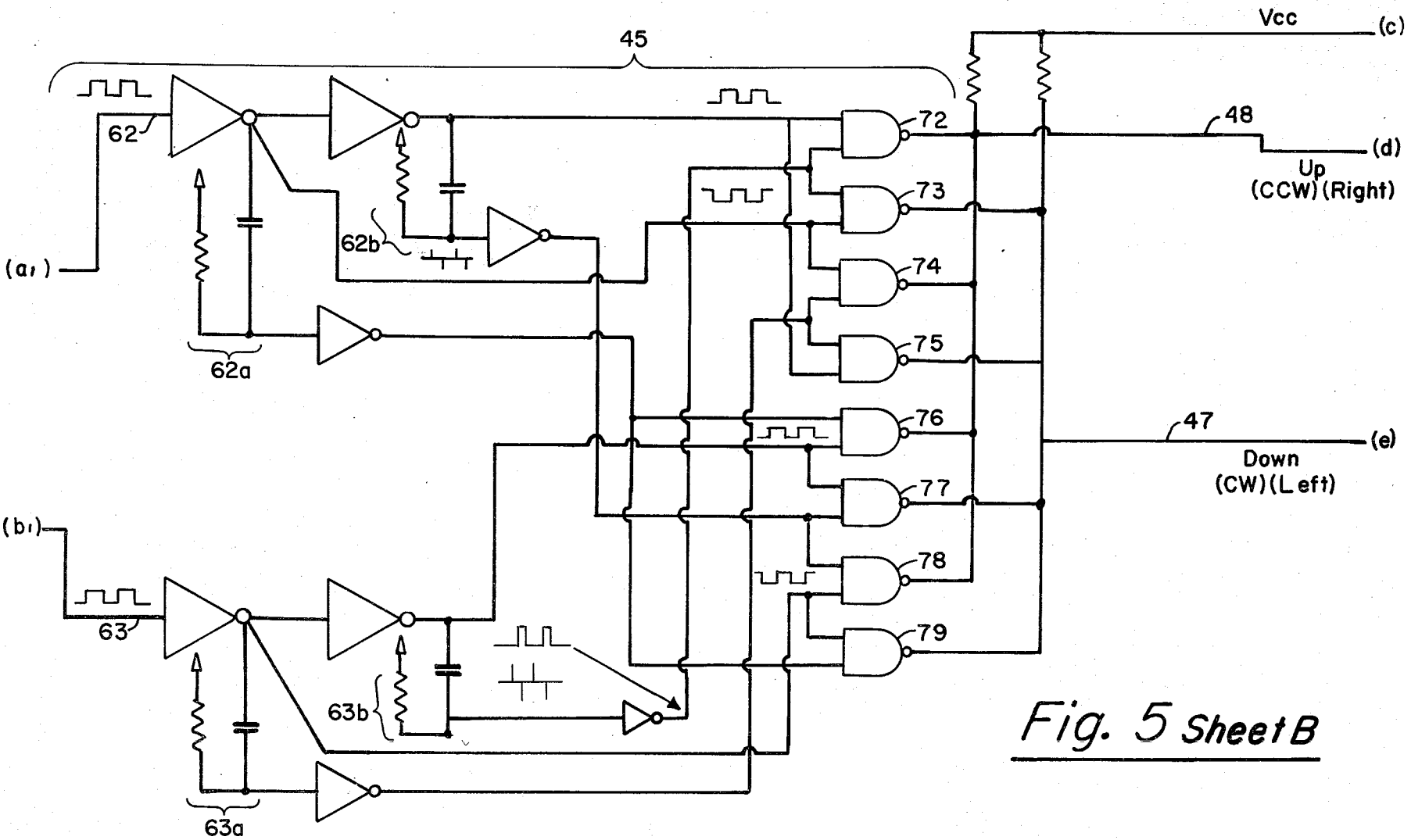
Fig. 5 Sheet B

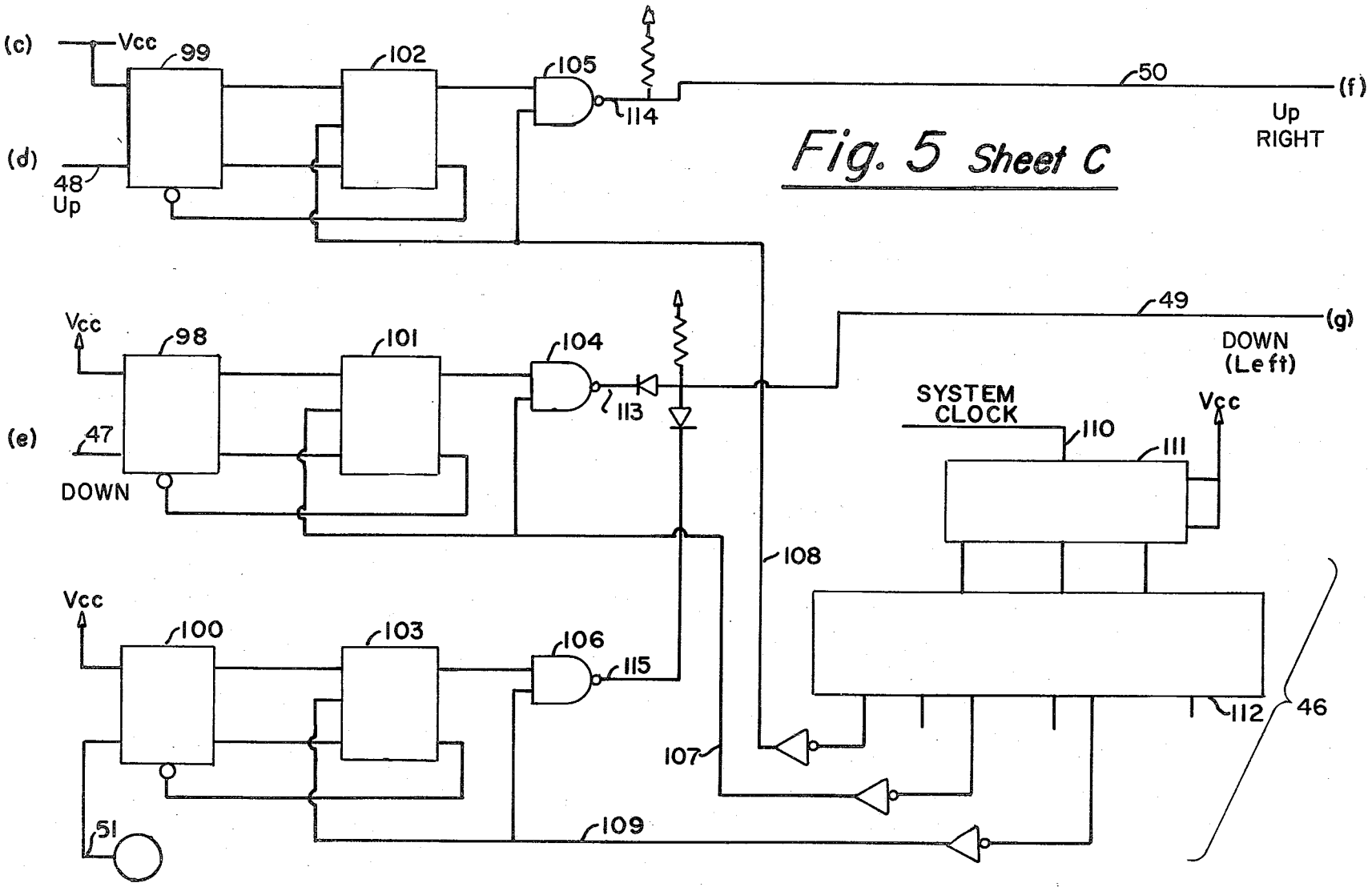
Fig. 5 Sheet C
(f)
Up
RIGHT
50
(g)
DOWN
(Left)
49
Vcc
111
110
SYSTEM
CLOCK
46
112
108
107
109
114
113
115
105
104
106
102
101
103
99
98
100
Vcc
48
Up
Vcc
47
DOWN
Vcc
51
(c)
(d)
(e)

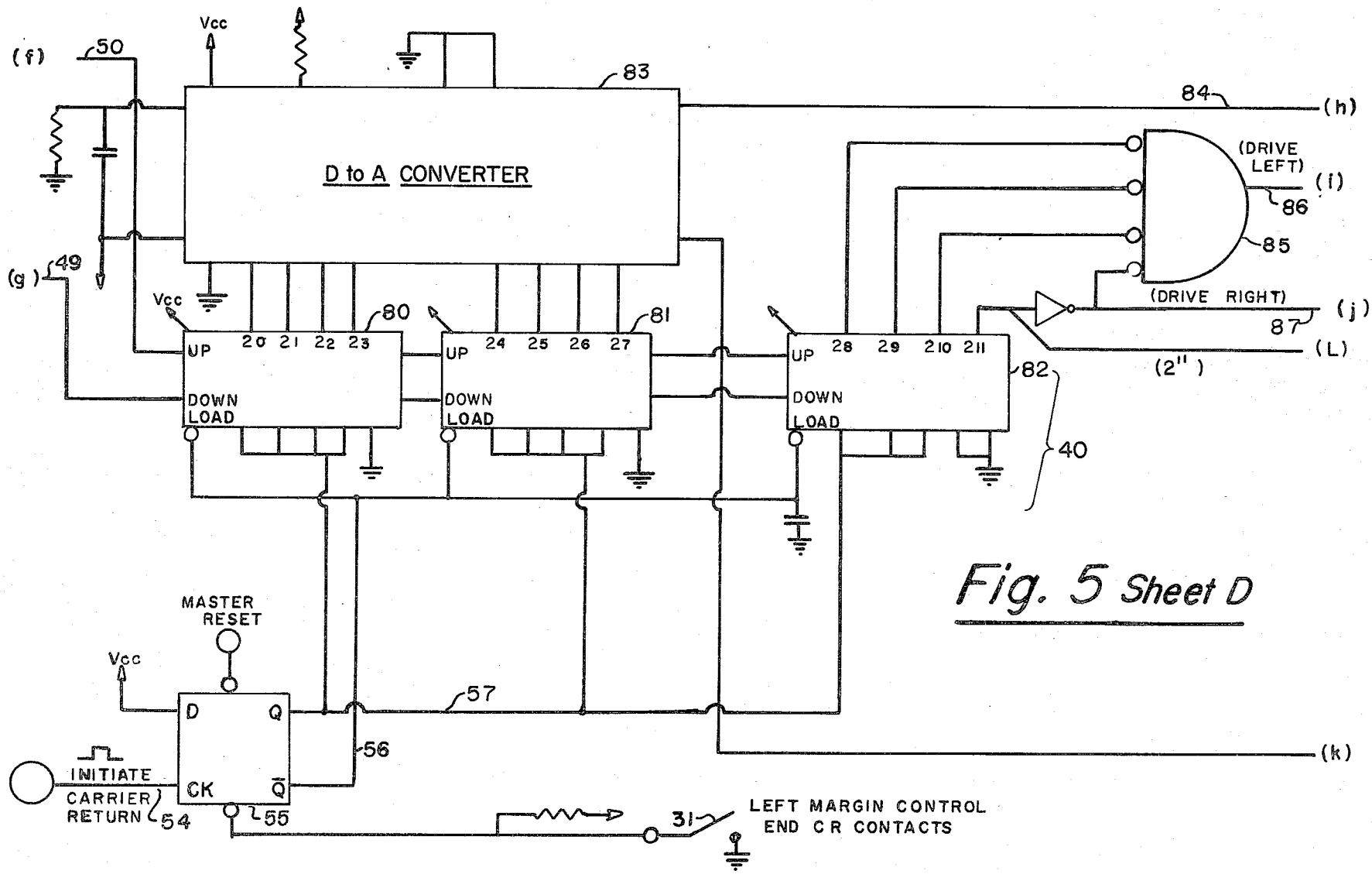
Fig. 5 Sheet D

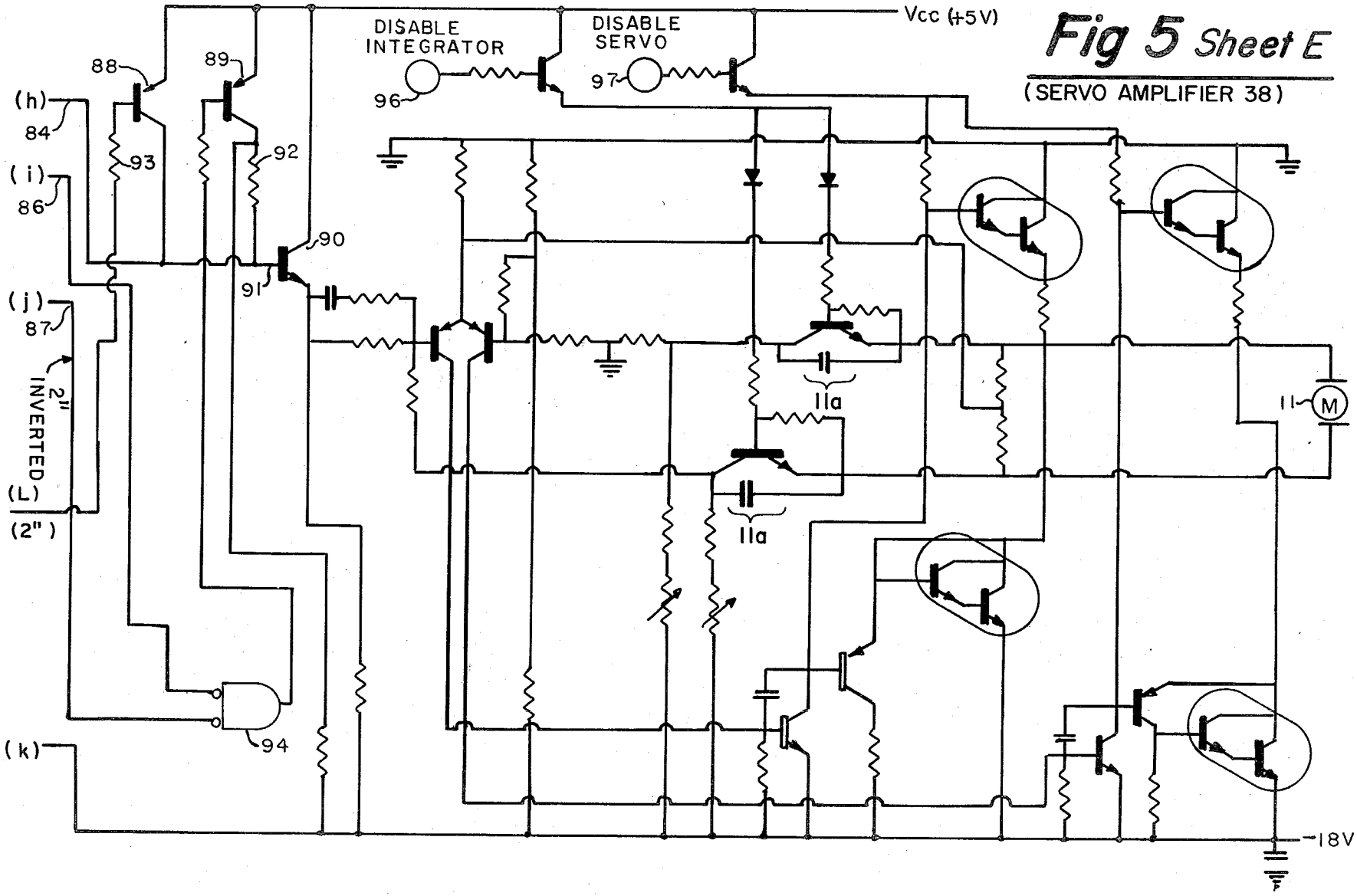
Fig 5 Sheet E
(SERVO AMPLIFIER 38)
Vcc (+5V)
-18V
M
11
11a
11a
DISABLE SERVO
97
DISABLE INTEGRATOR
96
90
91
92
89
88
93
94
(h)
84
(i)
86
(j)
87
2" INVERTED
(L)
(2")
(k)

PROPORTIONAL CARRIER CONTROL AND MOVING MECHANISM FOR ELECTRIC TYPEWRITER

This invention relates to a carrier control arrangement for an electric typewriter having a printing element mounted on a linearly movable carrier, and more particularly to such a control arrangement having a proportional spacing capability.

Electric typewriters having a single printing element mounted on a moving carrier are well known in the art, particularly those typewriters which employ a tiltable and rotatable ball type element. Various features of such typewriters are described, e.g., in U.S. Pat. Nos. 2,879,876; 2,919,002; 3,014,569; 3,077,971; 3,086,635; 3,352,398; and 3,612,239.

Such prior art typewriters, however, generally are either conventional fixed spacing machines which employ mechanical means to move the carrier by a fixed linear increment (corresponding to a single word space) each time a typewriter key is depressed, or are proportional spacing machines in which mechanical means provides a number (usually up to about 9) of proportional spacing increments corresponding to the depression of various typewriter keys.

There is need, however, for an arrangement which is relatively simple mechanically, to provide a wide dynamic range of proportional spacing capabilities in response to digital signals provided via the typewriter keyboard or a separate source of such signals.

Accordingly, an object of the present invention is to provide an arrangement for driving the carrier of an electric typewriter in a manner which is mechanically relatively simple and which exhibits a flexible proportional spacing capability.

As herein described there is provided a carrier control arrangement for an electric typewriter having a printing element mounted on a linearly movable carrier the magnitude of the movement of which is proportional to the angular rotation of a drive shaft and the direction of movement of which corresponds to the direction of rotation of said shaft, said arrangement comprising means for generating stepping pulses indicative of desired stepped movements of said carrier toward the right; means coupled to said drive shaft for generating first and second series of pulses corresponding to predetermined incremental rotational movements of said shaft in first and second directions respectively, and to predetermined linear incremental movements of said carrier to the right and left respectively; means for counting said stepping pulses and said first series of pulses in one direction and for counting said second series of pulses in the other direction; means for generating a carrier return signal to set said counting means to and maintain said counting means at a value corresponding to a count of a number of said second series of pulses; means adjacent the left margin of said typewriter for generating a carrier returned signal to render said counting means nonresponsive to said carrier return signal and set said counting means to a predetermined value; and drive means responsive to the count of said counting means for bi-directionally rotating said drive shaft in dependence on said count.

According to another aspect of the invention there is provided a carrier control arrangement for an electric typewriter having a printing element mounted on a linearly movable carrier the movement of which is proportional to the angle of rotation of a carrier drive shaft, the direction of said movement corresponding to the direction of rotation of said drive shaft, said arrangement comprising a motor responsive to a motor drive signal one for rotating said drive shaft in one direction in response to a first value of said signal, and for rotating said shaft in the opposite direction in response to a second value of said signal; pulse generating means coupled to said drive shaft for generating a pulse on a first line corresponding to each rotational movement of said shaft through a predetermined angular increment in said one direction corresponding to an associated incremental linear movement of said carrier in a first direction, and for generating a pulse on a second line corresponding to each rotational movement of said shaft through a predetermined angular increment in said opposite direction corresponding to an associated incremental linear movement of said carrier in a second direction; a source of carrier stepping pulses corresponding to desired stepped movements of said carrier in said first direction; means for generating a carrier return signal; means adjacent a left margin of said typewriter for generating a carrier returned signal when said carrier traverses sensing means associated with said carrier returned signal generating means; means for combining said stepping pulses with said pulses on said first line to provide a composite series of pulses wherein no pulses of said series are time coincident; counting means for counting up and down in response to said composite series of pulses and said pulses on said second line, said composite series of pulses being counted in one of said directions and said pulses on said second line being counted in the other of said directions; means responsive to said carrier return signal for setting said counting means to and maintaining said counting means at a first predetermined value until receipt of said carrier returned signal, and responsive to said carrier returned signal for thereupon setting said counting means to a second predetermined value; and means responsive to the count of said counting means for generating said motor drive signal in accordance therewith.

IN THE DRAWING

FIG. 5 (Sheets A–E) is a functional schematic diagram of the electrical and optical elements employed in the carrier control arrangement of the invention;

The carrier control arrangement herein described employs a servo motor to controllably rotate a pulley to which the carrier is coupled by a flexible cord or wire. The servo motor turns a drive shaft coupled to the pulley, so that the carrier undergoes linear movement proportional to the angle of rotation of the drive shaft. The direction of linear movement of the carrier corresponds to the direction of rotation of the drive shaft. Preferably, the drive arrangement should be such that rotation of the pulley through three or four revolutions corresponds to a single complete movement of the carrier between the left and the right margins.

Movement of the carrier, i.e., drive to the servo motor, is controlled by a digital/analog servo control loop, employing sensors optically coupled to a disk which rotates with the drive shaft, for generating pulses indicative of the magnitude and direction of rotation of the drive shaft. These pulses are coupled to a digital counter, which counts up when the drive shaft rotates in one direction and counts down when the drive shaft rotates in the other direction. The output of the counter is coupled to a digital to analog converter, which in turn is coupled to a servo amplifier the output of which drives the servo motor. This loop, in the absence of an external stepping pulse input, operates to maintain the drive shaft at its existing angular position.

When it is desired to step the carrier to the right, by an amount corresponding to a number of linear increments associated with a given word space or letter to be typed, in a proportional spacing scheme, the corresponding number of stepping pulses is coupled to the counter, causing the servo loop to establish a new equilibrium corresponding to an angular position of the drive shaft shifted by an amount corresponding to the number of stepping pulses coupled to the counter. Carrier return is accomplished by latching the output of the counter at a clear or zero value, causing the servo loop to rotate the drive shaft continuously so that the carrier moves to the left. When the carrier has moved left to a position adjacent the left margin, a carrier returned switch actuated by engagement with the carrier disengages the carrier return latch and sets the output of the counter to a predetermined count corresponding to the number of increments between the left margin and the carrier returned switch. As a result, the servo loop is caused to stabilize at a position wherein the carrier is disposed precisely at the left margin.

The manner in which the aforementioned features are provided will be more clearly understood from the following detailed description.

Figure 1:
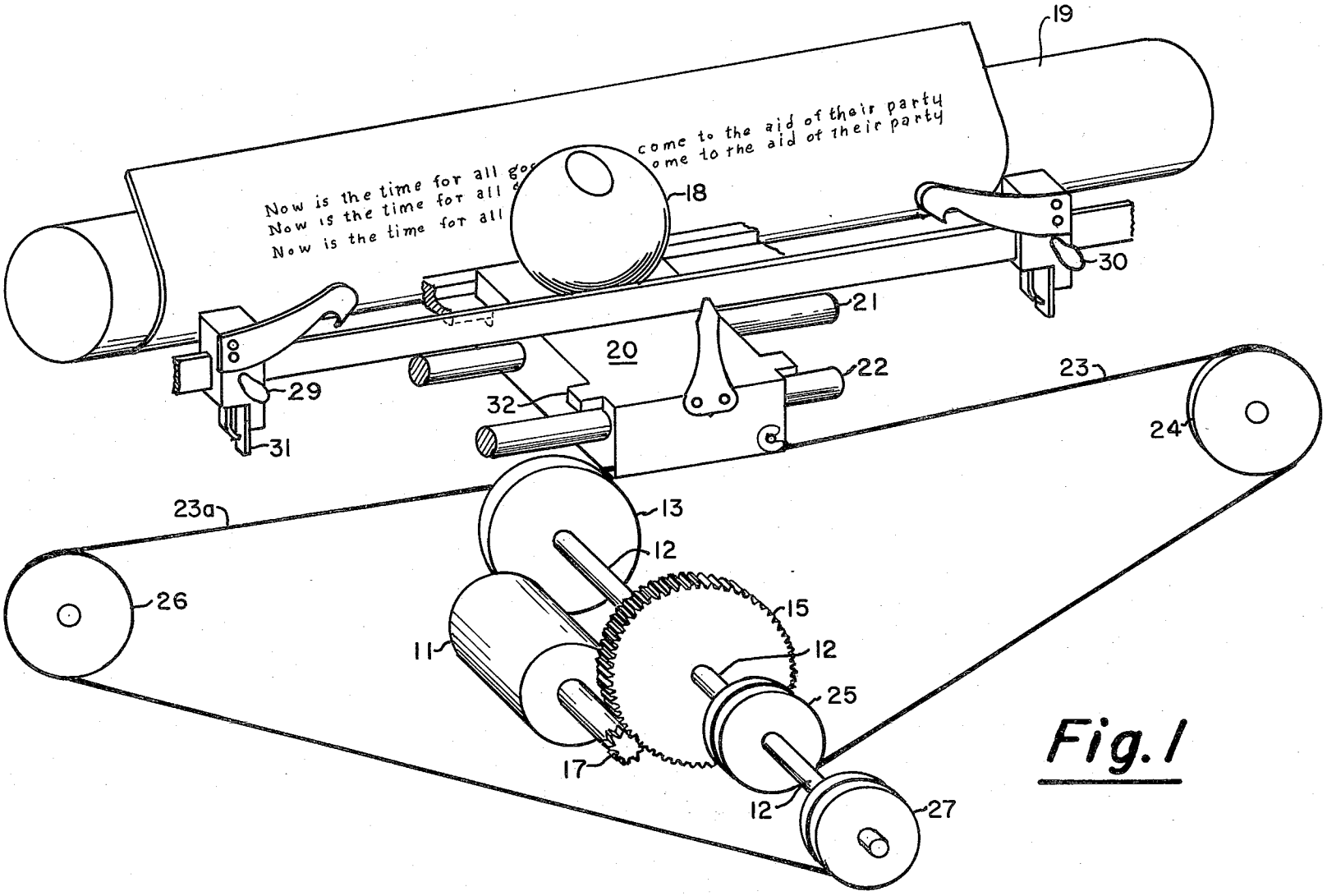
FIG. 1 is a perspective view showing the mechanical elements of a carrier control arrangement according to a preferred embodiment of the invention.
Figure 2:
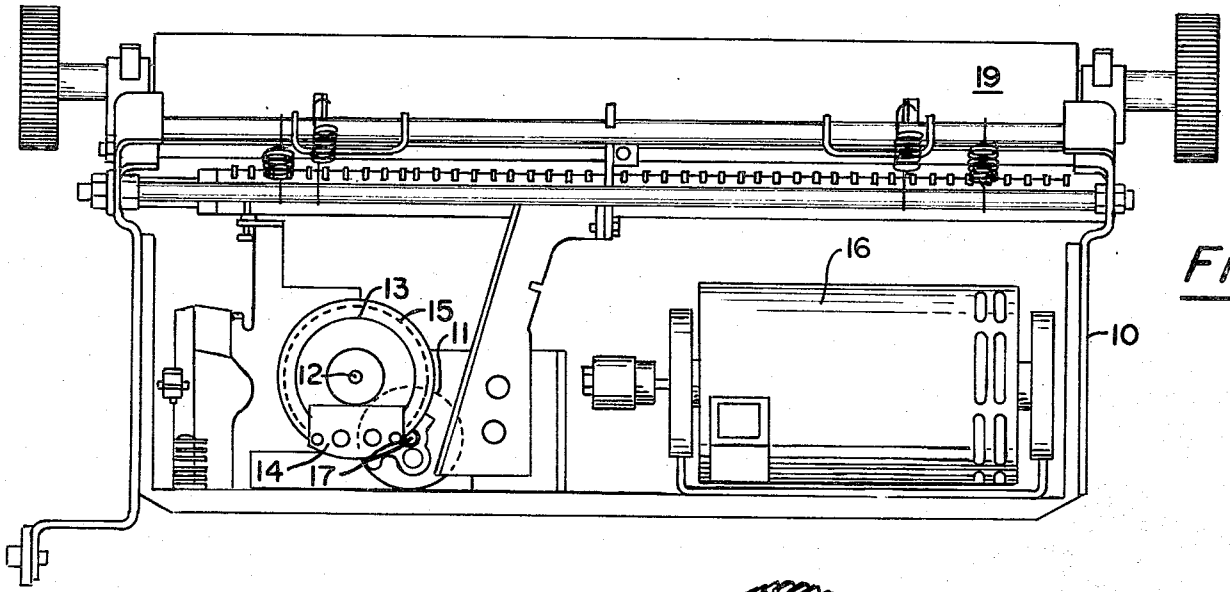
FIG. 2 is a partial rear view of a typewriter incorporating the control arrangement of FIG. 1.

A typewriter 10 (FIG. 2) has a main drive motor 16 for providing mechanical functions such as rotation and tilting of a single element type ball 18 (See FIG. 1) to cause impact printing on a platen 19 of selected letters formed on the surface of the type ball 18. The manner in which the type ball 18 is rotated and tilted is well known in the art, and forms no part of the present invention.

The type ball 18, daisy or other single element print head is mounted on a carrier 20 which has two parallel horizontal holes therein, through which stationary support bars 21 and 22 extend, facilitating sliding movement of the carrier 20 on the bars 21 and 22. Linear movement of the carrier 20 is provided by flexible cords, wires or cables 23 and 23*a*. A portion of the cord, wire or cable 23 secured to the right side of the carrier 20 passes around an idler 24 and is wound about a first pulley 25, with the other end of said portion 23 being secured to said first pulley 25.

Similarly, the portion 23*a* of the cord is secured at one end to the left side of the carrier 20 and is wound around an idler 26 and has the end thereof wound around and secured to a second pulley 27.

The pulleys 25 and 27 are fixed to a rotatable drive shaft 12, so that linear left and right movement of the carrier 20 is proportional to the angle of rotation of the shaft 12, and the direction of movement of the carrier 20 corresponds to the direction of rotation of the shaft 12.

Also secured to the drive shaft 12 for rotation thereof is a gear wheel 15 and an encoding disk 13 the periphery of which has alternating opaque and transparent radial striations. The periphery of the gear wheel 15 is engaged by a drive gear 17 on the shaft of the servo motor 11, so that as the servo motor 11 operates, the gear 17 thereof rotates the wheel 15 to rotate the drive shaft 12. The servo motor 11 is a DC motor having bidirectional capability, i.e. the motor 11 rotates in a direction corresponding to the direction of the drive current thereto.

The typewriter 10 has a conventional left margin control 29 and right margin control 30. These margin controls 29 and 30 may be slidably moved to the left or right, in manner well known in the typewriter art, to set the corresponding typewriter margins.

The carrier returned switch 31 is mounted on the left margin control 29 for movement therewith. The carrier returned switch 31 has a forwardly extending leaf which may be deflected by a rearwardly extending tab 32 on the carrier 20, as the carrier 20 approaches the left margin of the typewriter 10. The distance between the left margin control 29 and the deflectable leaf of the carrier returned switch 31 is fixed at a predetermined value, so that upon return of the carrier 20 toward the left margin, the switch 31 is always actuated when the carrier 20 is a predetermined distance from the left margin.

A keyboard 52 (FIG. 6) of the typewriter 10 (FIG. 2) contains a carrier return key (not shown) for actuating a switch to generate the carrier return signal. The keyboard 52 also contains conventional alphanumeric keys (not shown), with means associated with each key for generating a number of stepping pulses corresponding to the number of increments associated with the width of the corresponding character to be printed.

In a preferred embodiment of the invention, a 12 bit counter 40 (FIG. 6) is employed to control the position of the carrier 20. Since this counter 40 has a capacity of 4,096 increments, the distance increment corresponding to each count of the counter 40 is the maximum distance between the left and right margins divided by 4,096. For a 12 inch carriage capacity, or maximum distance between the margins, the corresponding distance increment would be 12 divided by 4,096 or approximately 0.003 inches. Thus an average size character in pica type (ten characters per inch) would be associated with a space of 0.1 inches, or 30 increments or counts of the arrangement herein described. A narrow letter such as i might require, e.g., 15 increments, while a wide letter such as m might require 45 increments. Thus it is evident that the system herein described provides a high resolution for proportional spacing purposes, and if desired is capable of accommodating a proportional spacing arrangement in which each letter or symbol has a different width or associated space.

Thus, the carrier control arrangement herein described utilizes as an input thereto a series of groups of stepping pulses, wherein the number of pulses in each group corresponds to the number of carrier increments in the desired word space corresponding to a depressed key on the keyboard 52 of the typewriter 10.

Techniques for generating such groups of pulses are simple and known in the art, and are therefore not described in any detail here. One such technique would be to address a corresponding storage cell not shown, in a random access memory not shown upon depressing a particular key of the typewriter keyboard 52 (FIG. 6), with said cell containing a digital word in keyboard encoder 53 and means for emitting the defined number of stepping pulses to be "clocked out" respecting the depressed key. A series of pulses from a clock oscillator in encoder 53 could then be fed to the instant carrier control arrangement and simultaneously fed to a bidirectional counter 40, with the coupling of said pulses from the carrier control arrangement being halted when the output of the counter 40 corresponds to the desired number of pulses as established by the digital "word" from the addressed random access memory cell. Such digital techniques are well known in the art.

Figure 3:
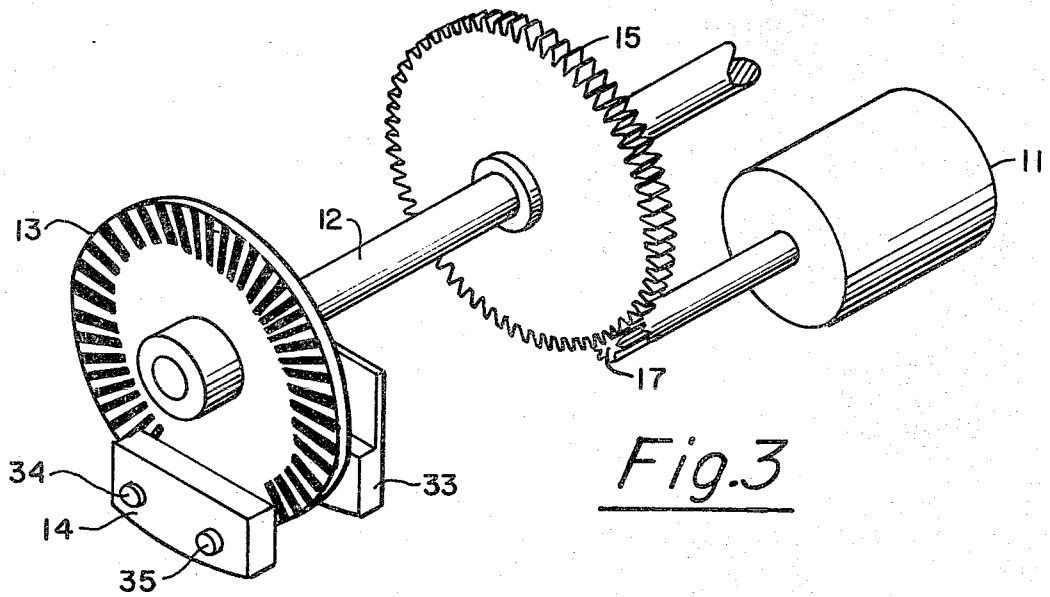
FIG. 3 is a perspective view showing the mechanical elements of the angular position sensor incorporated in the arrangement of FIG. 1.
Figure 4:
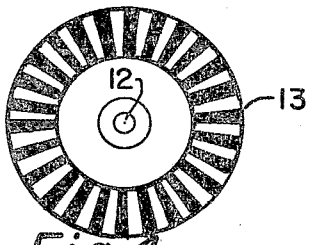
FIG. 4 shows the encoding disk employed in the angular position sensing arrangement of FIG. 3.

The drive for the shaft 12 and the optical encoding disk 13 are more clearly illustrated in FIG. 3, and the configuration of the disk 13 is more fully illustrated in FIG. 4.

An optical sensor assembly 14 detects transmission of light through the transparent regions of the disk 13, the light transmitted being provided by light sources comprising light emitting diodes 36 and 37 (FIG. 5, sheet A) mounted upon a light source assembly 33 (FIG. 3).

As can be seen in FIG. 4, the periphery of the disk 13 comprises an annular region having a multitude of radially extending alternating transparent and opaque striations. Preferably, the disk 13 has on the order of 500 of such striations. The light sensing unit 14 comprises phototransistors 34 and 35, aligned with corresponding light emitting diodes 36 and 37 supported by the light source assembly 33. The light transmission paths between the light emitting diodes 36 and 37 and corresponding phototransistors 34 and 35 are such that each light path traverses several striations of the encoding disk 13, for improved optical efficiency.

Disposed in each light path adjacent the phototransistors 34 and 35 are respective stationary masks 41 and 42, each mask of the masks 41 and 42 comprising a segment in optical alignment with and having a configuration corresponding to that of the periphery of the encoding disk 13. The striations in the optical paths of the phototransistors 34 and 35 are spaced apart and positioned one half of a striation out of phase with respect to each other. That is, the masks 41 and 42 are angularly displaced with respect to each other so that upon rotation of the disk 13 the waveform of current through the phototransistor 34 is 90° out of phase with the waveform thereof through the phototransistor 35. As hereafter explained, this 90° phase difference between the signals provided by said phototransistors 34 and 35 enables a determination as to the direction of rotation of the disk 13.

During time intervals when the opaque and transparent striations of the disk 13 are aligned with the opaque and transparent striations of one of the masks 41 and 42, i.e. opaque bands aligned with opaque striations and transparent striations aligned with transparent striations, there is maximum light transmission to the corresponding phototransistor 34 or 35. When the opaque striations of the disk 13 are aligned with the transparent striations of the mask 41 or 42, and the transparent striations of the disk 13 are aligned with the opaque striations of the mask 41 or 42, there is no light transmission to the corresponding phototransistor 34 or 35. Thus as the disk 13 rotates light transmission to each of the phototransistors 34 and 35 varies between zero and a maximum value, producing a corresponding cyclical waveform in the phototransistor output. It is desirable that the phototransistor output waveforms, which approximate distorted triangular waves, exhibit approximately a fifty (50%) percent duty cycle. It has been found that the duty cycle of the phototransistor output is dependent upon the intensity of light from the corresponding light emitting diodes 36 or 37. The phototransistor output waveform is ideally triangular but due to lack of parallel light, diffraction and lack of opacity of the mask 41 or 42, as well as lack of perfect parallelism between the stationary and moving masks 13 and 41 or 42, has the appearance of a distorted triangular wave. This output waveform must be electronically squared by a limiting amplifier 43 and 44 (FIG. 5, sheet A) or other suitable means. It is necessary to bias the resulting waveform so that it is centered at the output of the limiting amplifier 43 or 44 to control (during the constant velocity carriage return) the duty cycle, so that a fifty (50%) percent duty cycle is achieved. Accordingly, a feedback control system is provided to vary the intensity of light from each of the light emitting diodes 36 and 37 so as to maintain approximately a fifty percent duty cycle at the output of the phototransistors 34 and 35.

Figure 6:
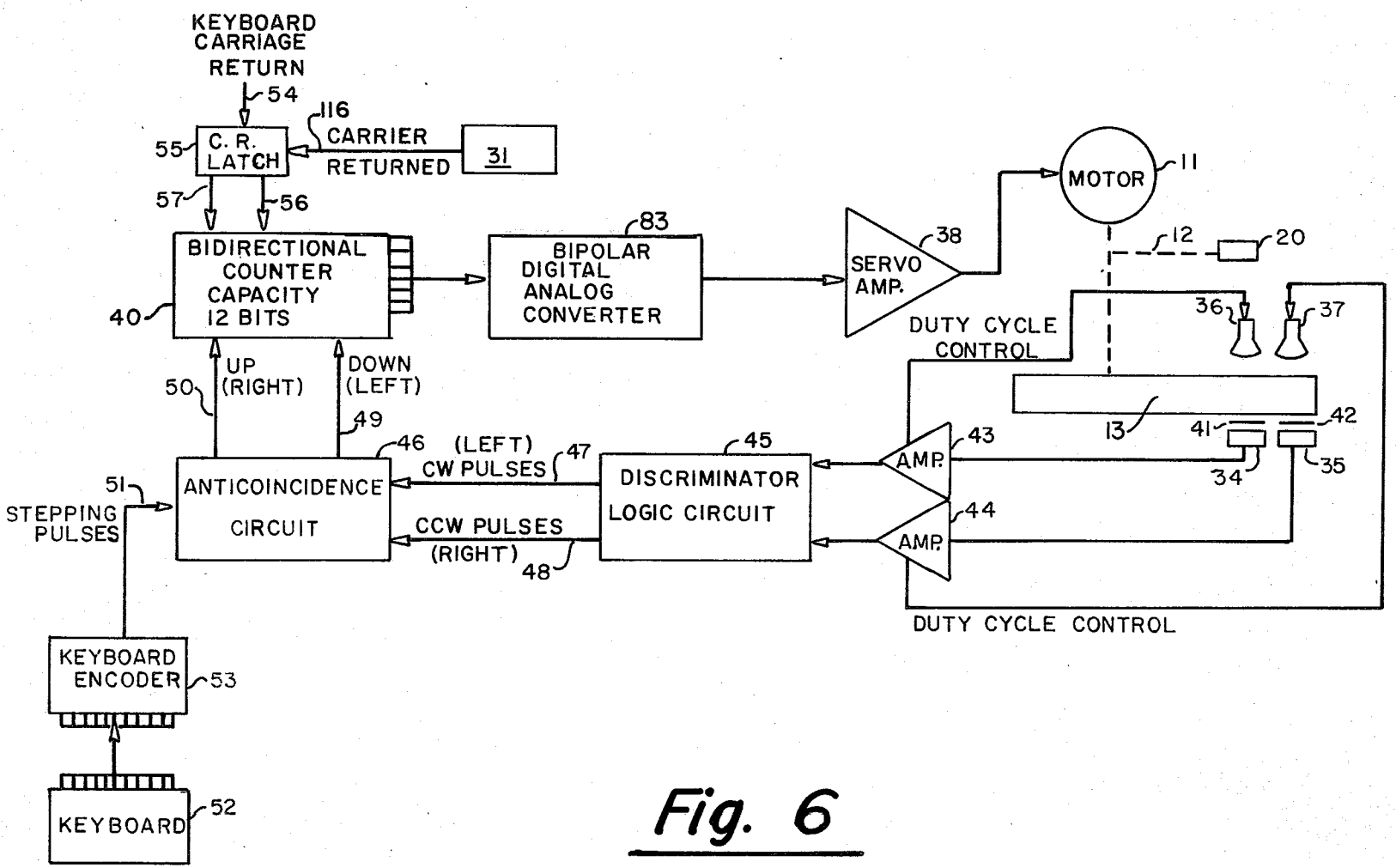
FIG. 6 is a functional block diagram of the carrier control arrangement of the invention.

The manner in which the servo loop of the invention operates will be best understood by reference to FIG. 6, which shows a functional block diagram thereof.

Figure 9:
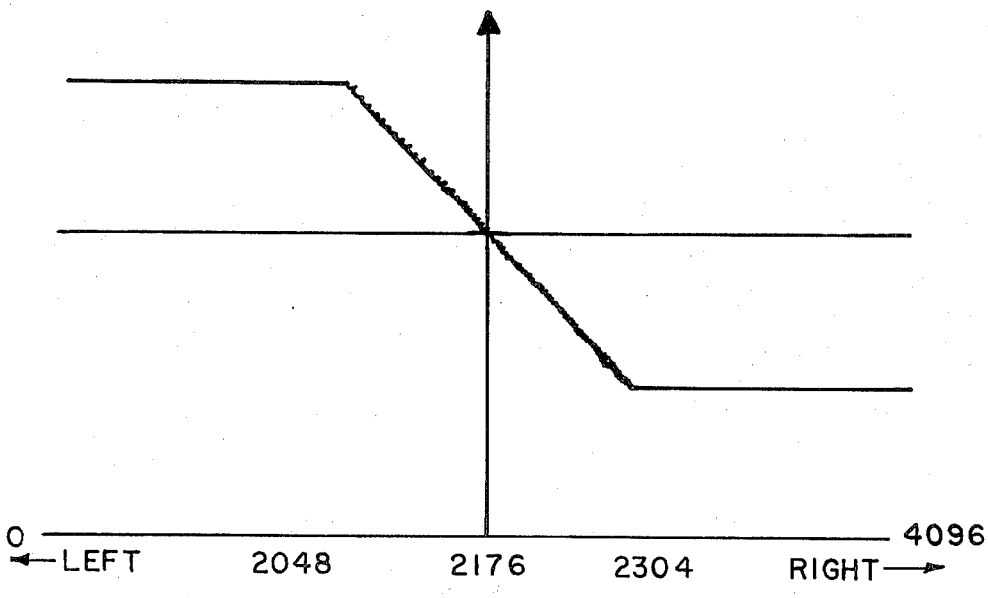
FIG. 9 illustrates the error response of the servo loop employed in the arrangement of FIGS. 1 to 6.

Under steady state conditions the disk 13 is stationary, and the servo loop is quiescent. In this quiescent condition the servo amplifier 38 receives a signal from the bipolar digital-analog converter 83 which causes the servo amplifier 38 to provide no drive to the motor 11. The output of the bidirectional or up/down digital counter 40, which has a 12 bit capacity, is in the center of its operating range. That is, as more clearly illustrated in FIG. 9, under quiescent conditions the output of the digital counter 40 has a value of 2176. The counter 40, digital to analog converter 83 and associated logic circuitry provide an error signal response as indicated in FIG. 9, in which the drive signal provided by the servo amplifier 38 to the servo motor 11 has a zero value when the output of the counter 40 is 2176, with the motor drive signal varying approximately linearly with the output of the counter 40 for counts of up to 2304 or down to 2048, i.e., a linear range corresponding to a range of 8 bits or a total count range of 256. When the output of the counter 40 is above 2304 or below 2048 the motor drive signal saturates, causing the servo motor 11 to be driven at full speed in either a clockwise or counterclockwise direction thereof.

Thus the servo loop shown in FIG. 6 at all times tends to operate to drive the servo motor 11 so that the output of the counter 40 has a value of 2176. If the output of the counter 40 is increased above 2176 the motor 11 will be driven in one direction so as to reduce the counter output; and if the output of the counter 40 has a value below 2176 the motor 11 will be driven in the opposite direction so as to increase the counter output. In the steady state or quiescent condition, the counter output is, (as previously mentioned) 2176, and there is no drive to the motor 11. Any rotation of the drive shaft 12 by hand or by any external interference with the operation of the servo loop, will result in generation of pulses via the phototransistors 34 and 35 (via light transmitted from the light emitting diodes 36 and 37 through the disk 13 and masks 41 and 42 respectively) which are coupled through amplifiers 43 and 44 respectively, a discriminator logic circuit 45, and an anticoincidence circuit 46 to drive the counter 40 in a direction such that the servo motor 11 rotates the shaft 12 in the opposite direction to return said shaft 12 to its equilibrium position.

The purpose of the discriminator logic circuit 45 is to process the waveforms from the phototransistors 34 and 35 to provide output signals on lines 47 and 48 corresponding to clockwise and counterclockwise incremental angular rotational movements of the disk 13 (and shaft 12) respectively.

The disk 13 rotates approximately four revolutions for one complete movement of the carrier 20 between the left and right margins. Since the disk 13 may have 250 transparent striations and 250 opaque striations, it provides 250 "cycles" of output waveform from the phototransistors 34 and 35 for each disk revolution, or approximately 1000 cycles for the (approximately) four revolutions. Since the discriminator logic circuit 45, as hereafter described, provides four output pulses for each "cycle", the circuit 45 generates approximately 4000 output pulses for the four disk revolutions. For example, the disk 13 makes slightly more than four revolutions for a complete carrier movement between the left and right margins, so that the discriminator logic circuit 45 provides, for example, 4096 pulses for one complete carrier movement between said margins, i.e., a number of pulses corresponding to the count capacity of the counter 40.

These clockwise and counterclockwise pulses on lines 47 and 48 are rotated through the anticoincidence circuit 46 to provide corresponding up and down count signals to the counter 40 on lines 50 and 49 respectively.

The function of the anticoincidence circuit 46 is to accept stepping pulses on line 51 received from the keyboard 52 via the keyboard encoder 53, and the feedback control pulses on lines 47 and 48, in such a manner that none of said pulses is "lost", even though said pulses may occur simultaneously in time with each other. This is accomplished by rapidly time sequencing or essentially multiplexing the three pulse signals on lines 47, 48 and 51 through the output lines 49 and 50 of the anticoincidence circuit 46.

As previously mentioned, the keyboard 52 contains various alphanumeric keys electrically coupled to the keyboard encoder 53, so that upon depression of a particular key the encoder 53 provides a number of stepping pulses corresponding to the desired number of increments of the carrier 20 for the character or word space corresponding to the depressed key. Thus, when a stepping pulse on line 51 is coupled to the counter 40 through the anticoincidence circuit 46, via line 49, the counter 40 is caused to count down by one, i.e., from 2176 to 2175 (FIG. 9). Alternatively, stepped operation in the reverse direction can be provided by coupling the stepping pulse on line 51 to the counter 40 through the anticoincidence circuit 46, via line 50 rather than line 49. It would be a simple expedient to provide switching so that stepping operation is provided in both forward and reverse directions. As a result, the digital-analog converter 83 (FIG. 6) provides a drive signal to the servo amplifier 38, causing the motor 11 to rotate to turn the drive shaft 12 so as to move the carrier 20 one increment to the right, simultaneously causing generation of a single pulse on line 48, said pulse being coupled to the counter 40 via line 50 to drive the counter 40 up by one count, so that the counter 40 returns to the quiescent count of 2176 and the motor 11 ceases to cause further rotation of the shaft 12. Thus the shaft 12 has been caused to rotate to move the carrier 20 one increment to the right in response to one stepping pulse on line 51.

In practice, stepping pulses appear on line 51 in groups, and the motor 11, due to inertia in the motor 11 and rotating parts associated therewith, may overshoot the desired new position of the shaft 12. However, the servo loop will operate in the manner described above to stabilize the motor 11 at the desired position of the shaft 12.

The design of suitable phase-gain characteristics for the servo loop for stable operation and optimum response involves techniques well known in the servomechanism art, and such design techniques are therefore not detailed here.

Whenever a group of stepping pulses appears on line 51 more rapidly than the servo loop can cause the motor 11 to rotate the drive shaft 12 in synchronism therewith, the servo loop continues to operate in normal fashion, since the stepping pulses on line 51 are substantially immediately coupled to the counter 40 to change its count by a corresponding amount, thus effectively "storing" the stepping pulse information until the motor 11 is able to rotate the shaft 12 and disk 13 to generate the requisite number of pulses on line 48 (or on line 47 in the event of a damped oscillation effect) to return the output of the counter 40 to its quiescent value.

When it is desired to return the carrier 20 to the left margin, the carrier return key on the keyboard 52 is depressed, causing a carrier return signal to be provided on line 54 to the carrier return latch or bistable circuit 55. The carrier return latch 55 is "set" by the carrier return signal on line 54, so that the output of the latch 55 on line 56 sets the counter 40 output to 2304. The output of the latch 55 on line 56 is maintained until the latch 55 is released by the carrier returned signal from the carrier returned switch 31 on line 116. That is, as the carrier 20 approaches the left margin control 29, the switch 31 is tripped to cause the carrier returned signal to release the latch 55 so that the counter 40 is allowed to count normally to balance the servo at the count of 2176. This causes the servo loop to drive the carrier 20 an additional 128 increments to the left (see FIG. 9). The sensing leaf of the carrier returned switch 31 is positioned 128 increments (i.e., $\frac{3}{8}$ inch) to the right of the left margin, so that the carrier 20 is positioned by the servo loop precisely at the left margin. Thereupon the servo loop remains quiescent until stepping pulses are provided thereto on line 51.

The detailed configuration of a specific example of a servo loop shown in FIG. 6 is illustrated in FIG. 5. The arrangement shown in FIG. 5 operates in substantially the same manner as was previously described with reference to FIG. 6. However, for circuit design reasons the values of the outputs of the digital counter 40 may be somewhat different than those in FIG. 9. This difference in value of balance has no significant effect on the operation of the servo loop.

In FIG. 5, sheet A shows the optical pulse generating and duty cycle control arrangement comprising light emitting diodes 36 and 37, phototransistors 34 and 35, disk 13, masks 41 and 42, and amplifiers 43 and 44. Sheet B of FIG. 5 shows the discriminator logic circuit 45 (FIG. 6), while sheet C shows the anticoincidence circuit 46. The digital counter 40 and the digital-analog converter 83 are shown on sheet D of FIG. 5, while sheet E thereof shows the servo amplifier 38 and motor 11.

As shown on sheet A of FIG. 5, the carrier return latch signal on line 56 is coupled to gates 58 and 59 to enable the integrated output of the phototransistors 34 and 35 to control (during the constant velocity carriage return) the respective outputs of the light emitting diodes 36 and 37 to cause equal duty cycle of the outputs of the limiting amplifiers 43 and 44.

When feedback is released through gates 58 and 59, the proper setting of the current to the light emitting diodes 36 and 37 is maintained until the cycle is repeated, i.e., rebalanced each carriage return. Light emitting diodes 36 and 37 intermittently illuminate the phototransistors 34 and 35 respectively through disk 13 and respective masks 41 and 42, so that the output signal of each phototransistor 34 or 35, at points 62 and 63, has substantially the rectangular voltage waveform shown in FIGS. 7 and 8. In each of FIGS. 7 and 8 the waveform identified as "a" is provided by the phototransistor 34 at point 60, and the waveform identified as "b" is provided by the phototransistor 35 at point 61. Each output signal is amplified by a series of three inverting amplifiers 43 or 44 as shown in FIG. 5, sheet A, and the squared output thereof at points 62 (for phototransistor 34) and 63 (for phototransistor 35) are shown at $a_1$ and $b_1$, and are coupled back to the drive circuitry for the corresponding light emitting diodes 36 and 37 respectively. The signal on line 62 is integrated or filtered by amplifier 64 in conjunction with feedback capacitor 65 and input resistor 66, to provide a DC drive to emitter follower transistors 67 and 68, so that the drive to the light emitting diode 36, and thus the amount of light generated by said diode 36, depends upon the average DC level of the pulse waveform at point 62, i.e., on the duty cycle of said waveform. The parameters of the elements of the light emitting diode control circuit, i.e., the amplifier 64, capacitor 65 and resistor 66, as well as related elements, are selected so that the current provided to the light emitting diode 36 maintains the waveform at point 62 at approximately a fifty percent duty cycle. Variations from this duty cycle result in corresponding variations of the drive to the diode 36 to vary the light intensity thereof so as to return the duty cycle of the waveform at point 62 to the desired fifty percent value.

The arrangement comprising light emitting diode 37, integrating amplifier 69, and associated capacitor 70 and resistor 71, operate in a similar manner to maintain the light intensity of the diode 37 at a value such that the duty cycle at point 63 remains at approximately fifty percent.

Figure 7:
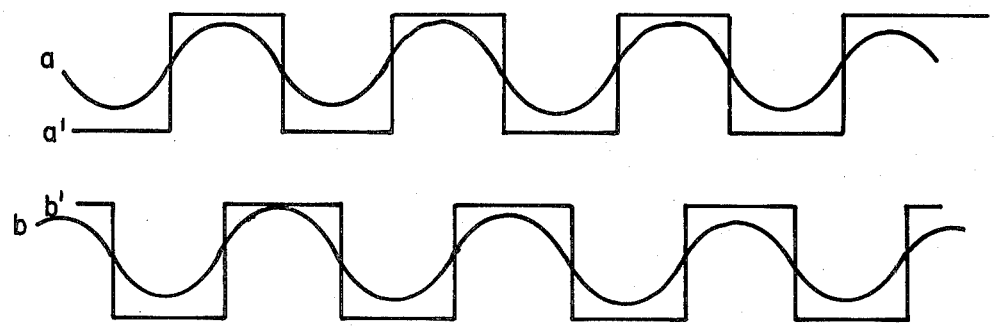
FIGS. 7 and 8 show waveforms involved in the optical sensing technique employed in the arrangement of FIGS. 1 to 6.
Figure 8:
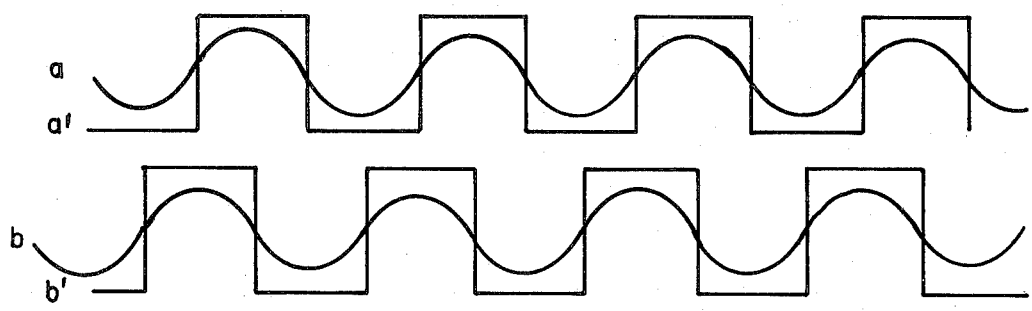

Thus, the waveforms at points 62 and 63 correspond to those indicated at $a_1$ and $b_1$ of FIGS. 7 and 8.

The operation of the discriminator logic circuit 45 (FIG. 6), shown in detail on sheet B of FIG. 5, will be best understood by reference to FIGS. 7 and 8. As clearly shown in said figures, the waveforms at points 62 and 63 are always 90° out of phase with respect to each other, due to the corresponding space phase relationship of the masks 41 and 42, as previously described. From FIG. 7 it is evident that when the disk 13 rotates in a clockwise direction, the relationship between the waveforms at points 62 and 63, i.e., the signals generated by the respective phototransistors 34 and 35, is such that four transitions (total) of said waveforms occur during each "cycle", i.e., alternation from an opaque to a transparent and back to an opaque band of the disk 13. The following relationship exists between the waveforms at points 62 and 63 when the disk 13 is rotating in a clockwise direction:

(i) waveform b is low at the time that there is a positive-going transition in waveform a;

(ii) waveform a is high at the time there is a positive-going transition in waveform b;

(iii) waveform b is high at the time there is a negative-going transition in waveform a; and (iv) waveform a is low at the time there is a negative-going transition in waveform b.

Similarly, when the disk 13 is rotating in a counterclockwise direction the following relationships exist between the waveforms a and b:

(i) at the time waveform b is high there is a positive-going transition in waveform a;

(ii) at the time waveform a is high there is a negative-going transition in waveform b;

(iii) at the time waveform b is low there is a negative-going transition in waveform a; and (iv) at the time waveform a is low there is a positive-going transition in waveform *b*.

These logical conditions are determined by the logic circuitry illustrated on sheet B of FIG. 5, wherein the various combinations of conditions are sensed by the eight inverting AND gates 72–79. The determination respecting positive-going and negative-going transitions is accomplished by using resistor-capacitor circuits 62*a* and *b*, and 63 and *b* to differentiate the respective waveforms.

The discriminator logic circuit 45 shown on sheet B of FIG. 5, provides the corresponding clockwise and counterclockwise pulses on lines 47 and 48 respectively.

The pulse signals on lines 47 and 48 are coupled (via the anticoincidence circuit 46 (FIG. 6) and corresponding lines 49 and 50) to an up-down digital counter 40 (see FIG. 5, sheet D) comprising integrated digital circuits 80, 81 and 82. Each of said circuits 80, 81 and 82 comprises a four bit digital up-down counter, with the output of the counter 80 being coupled as an input to the counter 81, and the output of the counter 81 being coupled as an input to the counter 82, so that the three circuits 80, 81 and 82 cooperate to form a twelve bit digital counter 40.

The outputs of the first eight bits of the counter 40, i.e., those designated $2^0$–$2^7$, are coupled to corresponding input terminals of an eight bit digital to analog converter integrated circuit 83. A typical circuit suitable for this purpose is sold under the part designation MC1408L-6 by Motorola Semiconductors. The converter 83 provides an analog DC output voltage on line 84 corresponding to the count of the first eight bits of the digital counter 40 comprising circuits 80 and 81 i.e., the count for bits $2^0$ through $2^7$, or a DC voltage on line 84 corresponding to the 256 count range. The outputs of the four most significant bits of the counting circuit 82, i.e., the bits corresponding to $2^8$, $2^9$, $2^{10}$ and $2^{11}$ inverted, are coupled as inputs to a negative AND gate 85, which provides a plus output signal on line 86 whenever the count of the digital counter 40 comprising circuits 80, 81 and 82 is from 2048 to 2304. That is, unless all outputs including $2^{11}$ inverted are absent (negative), the output of negative AND gate 85 on line 86 is low. The most significant bit of the circuit 82, i.e., the $2^{11}$ inverted bit, provides an output signal on line 87 only when the count of the digital counter 40 comprising circuits 80, 81 and 82 is below 2048.

Therefore an output is present on line 86 whenever the count of the counter 80, 81, 82 (comparable to the counter 40 of FIG. 6) is between 2048 and 2304.

Without influence of the above gating circuits, the output of the D to A converter 83 on line 84 would be a saw tooth repeated every 256 counts. The output of $2^{11}$ through an inverting transistor 88 clamps line 84 (h) positive for counts less than 2048. The output of the negative AND gate 94 through an inverting transistor 89 allows line 84 (h) to drop negative, allowing the saw tooth above the count of 2304 to stay negative. Thus, as the output of the counter 40 increases, the voltage on line 84 would decrease linearly for increments of 256 count, returns to plus, and again decreases for the next count of 256. Therefore a plot of DC voltage on line 84 against output count of the counter 40 comprising circuits 80, 81 and 82 would be a sawtooth waveform, with the sawtooth repeating itself for sixteen times as the output of the counter 40 goes from zero to its maximum count. In order to avoid any resulting ambiguity in operation of the servo loop, the signals from the above described logic are utilized to render the servo amplifier 38 responsive to the signal on line 84, to return to proper non-ambiguous balance count of 2176.

The operation of the servo amplifier 38 is forced between the counts of 2048 and 2304 by transistors 88 and 89. The servo amplifier input transistor 90 drives the remaining elements of the servo amplifier 38 in accordance with the signal present at its base electrode 91. With a low voltage at electrode 91 the servo amplifier 38 will provide drive to the motor 11 in a direction to move the carrier 20 to the left.

When transistor 88 is conductive, the $V_{cc}$ supply voltage is coupled directly to electrode 91 to cause the servo amplifier 38 to provide maximum drive to the motor 11 to cause the carrier 20 to move to the right.

When transistor 88 is nonconductive and transistor 89 is conductive, operating voltage for generation of the converter output on line 84 is supplied by a resistor 92, so that a voltage appears at electrode 91 to cause the motor 11 to be bidirectionally driven in accordance with the voltage present on line 84, which voltage varies in accordance with the count of the first eight bits of the counter 40 comprising circuits 80, 81 and 82.

When the count of the counter 40 is below 2048, a negative signal is present on line $L(2^{11})$, which signal is coupled to the base of transistor 88 via resistor 93 to turn on said transistor 88. Thus, when the count is below 2048, the servo amplifier 38 drives the motor 11 to move the carrier 20 to the right.

Thus the carrier 20 is caused to (i) move to the right when count of the counter 40 is below 2048, (ii) move bidirectionally in accordance with the count of the first eight bits of the counter 40 when the count is between 2048 and 2304, and (iii) move to the left when the count is above 2304. This error response characteristic is illustrated in FIG. 9, and eliminates any possible ambiguity respecting the settling or quiescent point of the servo loop.

As indicated in FIG. 5, sheet E, external signals may, if desired, be provided to disable the integrators 11*a* and 11*b* of the servo amplifier 38, or to disable the entire servo amplifier 38, via terminals 96 and 97 respectively.

The operation of the carrier return latch 55 is illustrated in FIG. 5, sheet D, wherein the output thereof on line 56 serves to load the counter 40 comprising circuits 80, 81 and 82; while the output on line 57 serves to set the counter 40 to a value of 2304.

The manner in which the anticoincidence circuit 46 shown on sheet C in FIG. 5 combines the stepping pulses on line 51 and feedback pulses on lines 47 and 48, is essentially as previously described. The pulses on lines 47, 48 and 51 occur at a typical repetition 10 kilohertz, and are stored in respective latches for bistable circuits 98, 99 and 100. The stored pulses are clocked out of said latches via respective flip-flops 101, 102 and 103, with each pulse being clocked out through a corresponding NAND gate 104, 105 or 106. Each time a pulse is clocked out via the flip-flops 101–103 and respective NAND gates 104–106, a gating signal is fed back to the corresponding one of the latches 98–100 to reset the latch 98, 99 or 100 in preparation for receipt of the next input pulse thereto on the corresponding line 47, 48 or 51. Gating pulses for clocking out the signals stored in the latches 98–100 are provided on lines 107, 108 and 109. These lines 107, 108 and 109 are provided with sequential pulses which occur at a much higher repetition rate than those on lines 47, 48 and 51. Typically the repetition rate of the pulses on lines 107, 108 and 109 may be on order of 1 megahertz.

The pulses on lines 107–109 are derived from a system clock oscillator 110 which generates pulses at a frequency which may be on the order of 8 megahertz on line 110 to a three bit digital counter 111, the outputs of said counter 111 being coupled to a binary decoder 112. Thus the outputs of the decoder 112 occur sequentially in well known fashion, and provide gating signals to provide output signals from the latches 98–100 sequentially on lines 113, 114 and 115 respectively. The sequential nature of the pulses on lines 107–109 ensures that there is no simultaneous occurrence of output pulses, so that values stored in the latches 98–100 corresponding to individual input pulses on lines 47, 48 and 51 are not lost due to any simultaneous occurrence thereof.

Since it is desired that the stepping pulses on line 51 result in movement of the carrier 20 to the right, as do the pulses on line 48, the distributed outputs on lines 113 and 115 corresponding thereto are coupled to a single output line 50.

What is claimed is:

1. A carrier control arrangement for an electric typewriter having a printing element mounted on a linearly movable carrier the movement of which is proportional to the angle of rotation of a carrier drive shaft, the direction of said movement corresponding to the direction of rotation of said drive shaft, said arrangement comprising:

an encoding disk rotationally coupled to said drive shaft;

first and second stationary pulse generating sensors coupled to said disk for generating first and second pulses corresponding to predetermined incremental rotational movements of said disk, each of said pulses having a given duty cycle when said carrier moves at a constant velocity;

a logic circuit responsive to said pulses for generating third and fourth control pulses corresponding to predetermined clockwise and counterclockwise incremental rotational movements of said disk respectively;

a distributor circuit responsive to said third and fourth pulses and to carrier stepping pulses for generating a first directional count pulse for each one of said stepping pulses provided thereto and for each one of said control pulses provided thereto corresponding to a direction of rotation of said shaft to advance said carrier in a given direction, said distributor circuit generating a second directional count pulse for each one of said control pulses provided thereto corresponding to a direction of rotation of said shaft to return said carrier in the opposite direction;

a bidirectional digital counter for counting in one direction in response to said first directional count pulses and counting in the opposite direction in response to said second directional count pulses, the output of said counter being set to a predetermined value in response to a carrier returned signal;

a digital-analog converter for generating an analog signal corresponding to the output of said counter;

an amplifier for generating a motor drive signal in response to said analog signal; and a motor for rotating said drive shaft and disk in response to said motor drive signal, so that said carrier is caused to move a predetermined incremental linear distance in said given direction in response to each of said stepping pulses, and to return in the opposite direction in response to a carrier return signal.

2. The arrangement according to claim 1, wherein said disk has spaced light transmissive areas disposed about the periphery thereof and said sensors each comprise a light source and a photosensor.

3. The arrangement according to claim 2, further comprising means responsive to the duty cycle of each series of pulses from said photosensors for controlling the intensity of the corresponding light sources.

4. The arrangement according to claim 2, further comprising stationary mask means having spaced light transmissive areas, said mask means being disposed between each light source and photosensor and aligned with said disk so that as said disk rotates each photosensor is periodically illuminated by the corresponding light source.

5. The arrangement according to claim 4, wherein said photosensors are positioned with respect to said disk and said mask means so that said photosensors are periodically illuminated with approximately a 90° phase angle therebetween.

6. The arrangement of claim 1, further comprising switch means having sensing means disposed a predetermined distance from a left margin of said typewriter for generating said carrier returned signal when said carrier has traversed said sensing means.

7. The arrangement of claim 3, wherein said light source intensities are controlled to maintain the duty cycle of each series of pulses at approximately 50%.

8. A carrier control arrangement for an electric typewriter having a printing element mounted on a linearly movable carrier the movement of which is proportional to the angle of rotation of a carrier drive shaft, the direction of said movement corresponding to the direction of rotation of said drive shaft, said arrangement comprising:

a motor responsive to a motor drive signal for rotating said drive shaft in one direction in response to a first value of said signal, and for rotating said shaft in the opposite direction in response to a second value of said signal;

pulse generating means coupled to said drive shaft for generating a pulse on a first line corresponding to each rotational movement of said shaft through a predetermined angular increment in said one direction corresponding to an associated incremental linear movement of said carrier in a first direction, and for generating a pulse on a second line corresponding to each rotational movement of said shaft through a predetermined angular increment in said opposite direction corresponding to an associated incremental linear movement of said carrier in a second direction;

a source of carrier stepping pulses corresponding to desired stepped movements of said carrier in said first direction;

means for generating a carrier return signal;

means adjacent a left margin of said typewriter for generating a carrier returned signal when said carrier traverses sensing means associated with said carrier returned signal generating means;

means for combining said stepping pulses with said pulses on said first line to provide a composite series of pulses wherein no pulses of said series are time coincident;

counting means for counting up and down in response to said composite series of pulses and said pulses on said second line, said composite series of pulses being counted in one of said directions and said pulses on said second line being counted in the other of said directions;

means responsive to said carrier return signal for setting said counting means to and maintaining said counting means at a first predetermined value until receipt of said carrier returned signal, and responsive to said carrier returned signal for thereupon setting said counting means to a second predetermined value; and means responsive to the count of said counting means for generating said motor drive signal in accordance therewith.

9. A carrier control arrangement for an electric typewriter having a printing element mounted on a linearly movable carrier the magnitude of the movement of which is proportional to the angular rotation of a drive shaft and the direction of movement of which corresponds to the direction of rotation of said shaft, said arrangement comprising:

means for generating stepping pulses indicative of desired stepped movements of said carrier toward the right;

means coupled to said drive shaft for generating a first and second series of pulses corresponding to predetermined incremental rotational movements of said shaft in first and second directions respectively, and to predetermined linear incremental movements of said carrier to the right and left respectively;

means for counting said stepping pulses and said first series of pulses in one direction and for counting said second series of pulses in the other direction;

means for generating a carrier return signal to set said counting means to and maintain said counting means at a value corresponding to a count of a number of said second series of pulses;

means adjacent the left margin of said typewriter for generating a carrier returned signal to render said counting means nonresponsive to said carrier return signal and set said counting means to a predetermined value; and drive means responsive to the count of said counting means for bidirectionally rotating said drive shaft in dependence on said count.

* * * * *